US010216210B2

(12) United States Patent
Li et al.

(10) Patent No.: US 10,216,210 B2
(45) Date of Patent: Feb. 26, 2019

(54) DUAL INPUT POWER MANAGEMENT METHOD AND SYSTEM

(71) Applicant: O2Micro Inc., Santa Clara, CA (US)

(72) Inventors: Guoxing Li, Sunnyvale, CA (US); Quanwang Liu, Sichuan (CN)

(73) Assignee: O2MICRO INC., Santa Clara, CA (US)

( * ) Notice: Subject to any disclaimer, the term of this patent is extended or adjusted under 35 U.S.C. 154(b) by 147 days.

(21) Appl. No.: 15/467,807

(22) Filed: Mar. 23, 2017

(65) Prior Publication Data

US 2018/0275704 A1 Sep. 27, 2018

(51) Int. Cl.
*G05F 1/59* (2006.01)
*G05F 1/567* (2006.01)
*G05F 1/573* (2006.01)

(52) U.S. Cl.
CPC ..... *G05F 1/59* (2013.01); *G05F 1/567* (2013.01); *G05F 1/573* (2013.01)

(58) Field of Classification Search
CPC ..... G05F 1/59; G05F 1/573; G05F 1/567
See application file for complete search history.

(56) References Cited

U.S. PATENT DOCUMENTS

2009/0066161 A1* 3/2009 Lu ..... H02J 7/0031 307/66
2009/0243570 A1* 10/2009 Hulfachor ..... G05F 1/573 323/276
2013/0176007 A1* 7/2013 Devegowda ..... G05F 1/573 323/273
2013/0328401 A1* 12/2013 Chen ..... H02J 9/061 307/64
2017/0063231 A1* 3/2017 Wang ..... H03M 1/12

* cited by examiner

*Primary Examiner* — Jared Fureman
*Assistant Examiner* — Duc M Pham

(57) ABSTRACT

A dual input power management method includes: monitoring whether a first input terminal has a power supply and whether a second input terminal has a power supply, and accordingly generating a first monitor signal and a second monitor signal; generating a priority signal based on the first monitor signal, the second monitor signal, and an enable signal, to determine an input priority of the first input terminal and the second input terminal; generating a control signal based on a feedback signal indicative of an output voltage and a reference signal; and regulating the output voltage based on the priority signal and the control signal.

20 Claims, 7 Drawing Sheets

DUAL INPUT POWER MANAGEMENT METHOD AND SYSTEM

BACKGROUND

Some electronic devices or systems, such as cell phones, laptops, camera recorders and other mobile battery operated devices, may include low drop-out (LDO) voltage regulators to provide relatively precise and stable direct current (DC) voltage.

FIG. 1A shows a conventional dual input power management system. As shown in FIG. 1A, two input terminals IN1 and IN2 connect to a LDO voltage regulator via a respective diode. The LDO voltage regulator selects the greater input voltage from the input terminals IN1 and IN2, and provides an output voltage $V_{OUT}$ on the output terminal OUT to a micro-processor (MCU). However, this does not allow input priority setting and enable setting.

Another conventional scheme is to utilize one LDO voltage regulator and multiple input power path selection switches controlled by an MCU. As shown in FIG. 1B, a power management system with dual input terminals IN1 and IN2 includes a LDO voltage regulator, an auxiliary circuit, and an MCU. The LDO voltage regulator provides an output voltage $V_{OUT}$ on the output terminal OUT to the MCU. The auxiliary circuit monitors whether the input terminals IN1 and/or IN2 have a power supply, and provides the power supply information to the MCU. The MCU generates enable signals EN1 and EN2 according to the power supply information, to selectively enable or disable switch 1 and switch 2 (e.g., a power switch chip). In this manner, a corresponding power supply (e.g., the power supply from the input terminal IN1 or IN2) is selected for LDO voltage regulation, thus generating the output voltage $V_{OUT}$ on the single output terminal OUT. However, this scheme requires that the MCU has multiple input/output interfaces (I/O) and proper firmware to control those discrete components. Thus, this is a high cost, high power consumption, high complexity solution and requires large Printed Circuit Board (PCB) space. Furthermore, since the MCU needs the auxiliary circuit to determine whether the input terminals IN1 and IN2 have a power supply, the power management system is unreliable during power mode conversion.

SUMMARY

Embodiments according to the present invention provide an improved dual input power management method and system.

In an embodiment, the present invention provides a dual input power management method, including: monitoring whether a first input terminal has a power supply and whether a second input terminal has a power supply, and accordingly generating a first monitor signal and a second monitor signal; generating a priority signal based on the first monitor signal, the second monitor signal, and an enable signal, to determine an input priority of the first input terminal and the second input terminal; generating a control signal based on a feedback signal indicative of an output voltage and a reference signal; and regulating the output voltage based on the priority signal and the control signal.

In an embodiment, the present invention provides a dual input power management system, including a dual input power regulator, wherein the dual input power regulator includes: a priority determination module, configured to: monitor whether a first input terminal has a power supply and whether a second input terminal has a power supply, and accordingly generate a first monitor signal and a second monitor signal; generate a priority signal based on the first monitor signal, the second monitor signal, and an enable signal to determine an input priority of the first input terminal and the second input; a feedback module, configured to generate a feedback signal indicative of an output voltage; a compare module coupled to the feedback module, and configured to generate a control signal based on the feedback signal and a reference signal; and an output stage module, coupled to the priority determination module and the compare module, and configured to regulate the output voltage based on the priority signal and the control signal.

Advantageously, in embodiments according to the present invention, the dual input power management method and system can achieve input priority setting in a low cost and highly efficient manner, and also can provide a reliable and stable output.

BRIEF DESCRIPTION OF THE DRAWINGS

Features and advantages of embodiments of the claimed subject matter will become apparent as the following detailed description proceeds, and upon reference to the drawings, wherein like numerals depict like parts, and in which:

DETAILED DESCRIPTION

Reference will now be made in detail to the embodiments of the present invention. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1A:
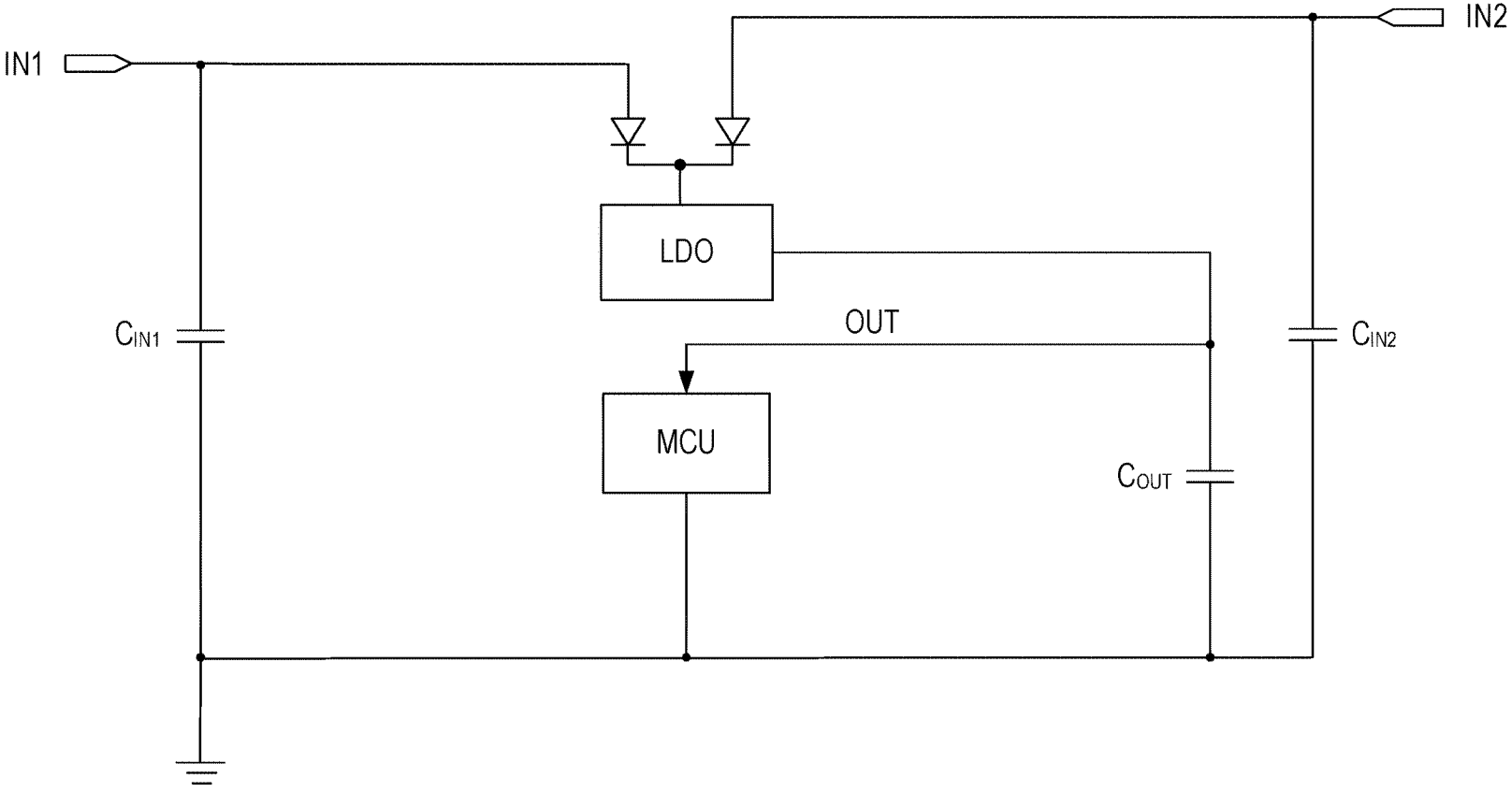
FIG. 1A PRIOR ART
FIG. 1A and FIG. 1B are block diagrams showing a conventional dual input power management system.
Figure 1B:
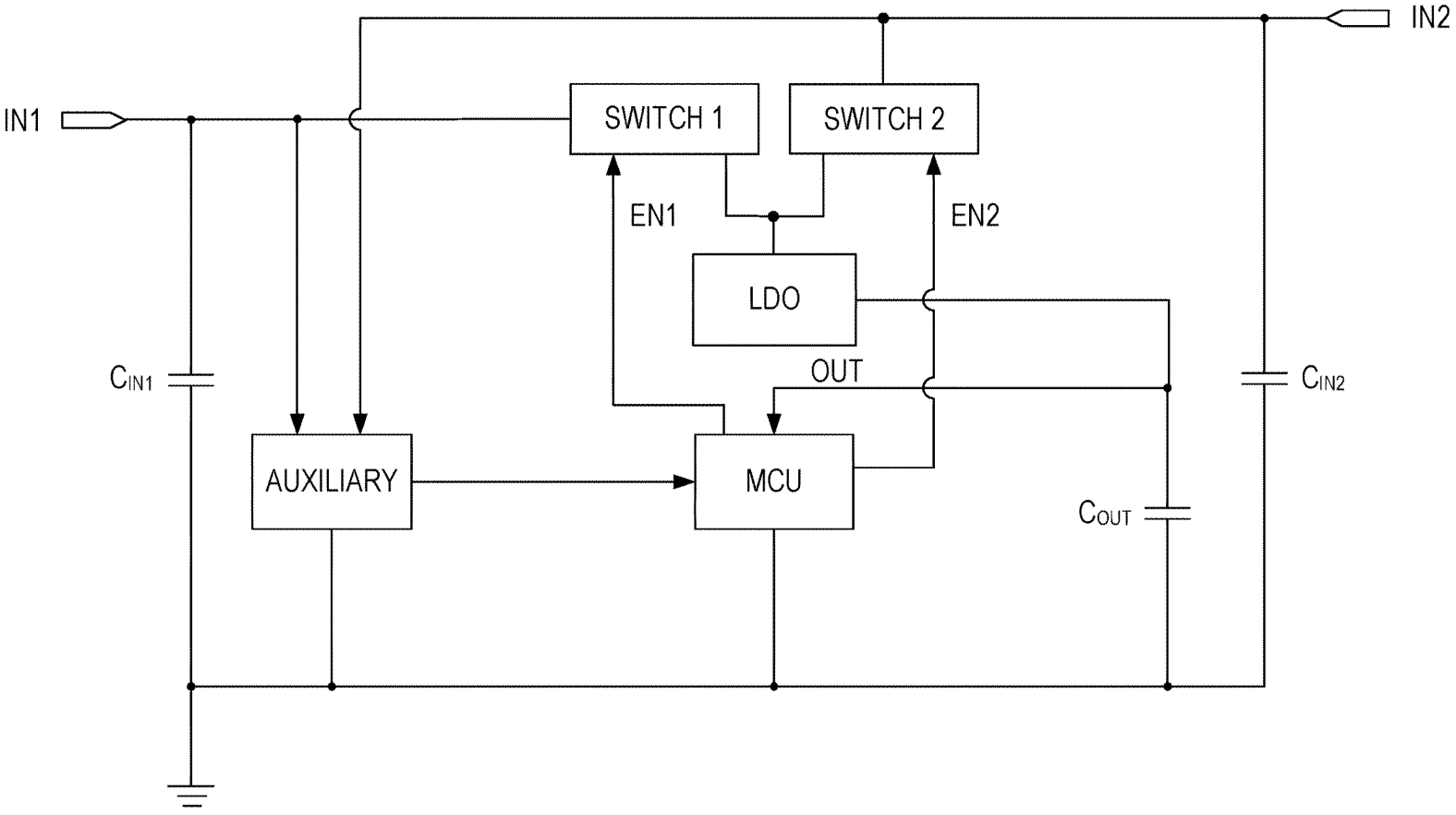
FIG. 1B PRIOR ART
Figure 2:
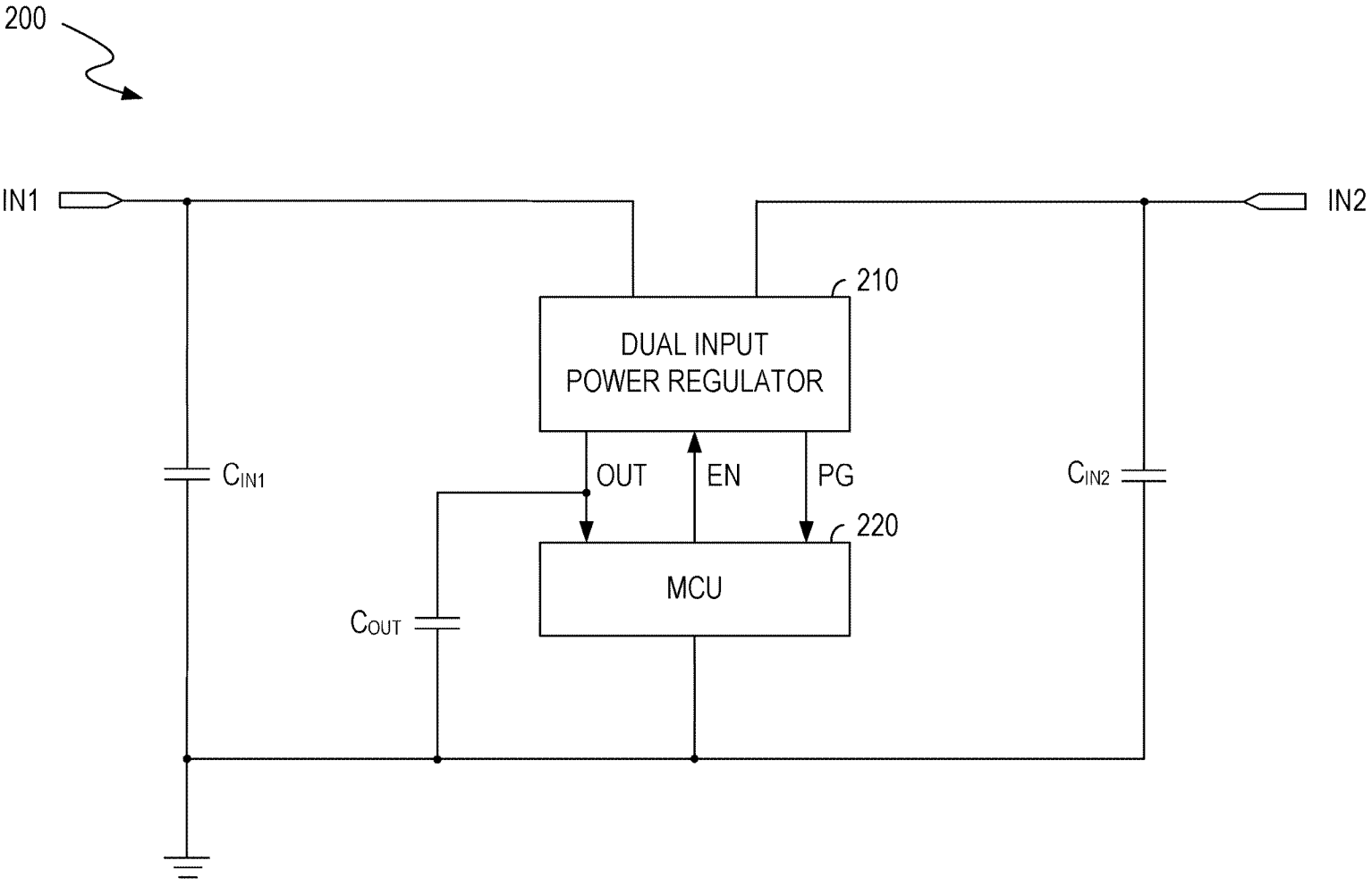
FIG. 2 is a block diagram showing a dual input power management system according to an embodiment of the present invention.

FIG. 2 is a block diagram showing a dual input power management system 200 according to an embodiment of the present invention. Unlike the conventional dual input power management system in FIG. 1A and FIG. 1B, the dual input power management system 200 of FIG. 2 includes a dual input power regulator 210, a processor (e.g., the MCU 220), and filter capacitors $C_{IN1}$, $C_{IN2}$, $C_{OUT}$, without the need for an auxiliary circuit or separate LDO voltage regulators. The dual input power regulator 210 provides an output voltage $V_{OUT}$ on an output terminal OUT and a power good signal PG to the MCU 220. The MCU 220 provides an enable signal EN to the dual input power regulator 210.

Specifically, the dual input power regulator 210 monitors whether a first input terminal IN1 (e.g., 6V) has a power supply and whether a second input terminal IN2 (e.g., 4.5V) has a power supply, and accordingly generates a first monitor signal and a second monitor signal. More specifically, if a first input voltage $V_{IN1}$ detected on the first input terminal IN1 is greater than a preset threshold, then the first monitor signal is in a first state (e.g., high level), which indicates the first input terminal IN1 has a power supply. If the first input voltage $V_{IN1}$ detected on the first input terminal IN1 is less than the preset threshold, then the first monitor signal is in a second state (e.g., low level), which indicates the first input terminal IN1 does not have a power supply. Similarly, if a second input voltage $V_{IN2}$ detected on the second input terminal IN2 is greater than a preset threshold, then the second monitor signal is in a first state (e.g., high level), which indicates the second input terminal IN2 has a power supply. If the second input voltage $V_{IN2}$ detected on the second input terminal IN2 is less than the preset threshold, then the second monitor signal is in a second state (e.g., low level), which indicates the second input terminal IN2 does not have a power supply. The MCU 220 provides the enable signal EN to the dual input power regulator 210, which can be used in combination with the first monitor signal and the second monitor signal to make the dual input power regulator 210 enter a normal operation mode (e.g., consume five micro-amps (μA) of current) or a shutdown or low current mode (e.g., only consume one μA current). Based on the first monitor signal, the second monitor signal, and the enable signal EN, the dual input power regulator 210 determines the input priority of the first input terminal IN1 and the second input terminal IN2 and accordingly generates the output voltage $V_{OUT}$ on the output terminal OUT. More details are provided below in Table 1. Although the invention will be described in conjunction with the priority determination logic of Table 1, the invention is not so limited. On the contrary, the invention covers other proper priority determination logics.

TABLE 1

Example of Priority Determination Logic

| IN1 | IN2 | Input Priority | EN | OUT |
|---|---|---|---|---|
| Input | N/A | IN1 | Low | N/A |
| Input | N/A | IN1 | High | Output |
| N/A | Input | IN2 | High or Low | Output |
| Input | Input | IN2 | High or Low | Output |

As shown in Table 1, in one example, if the input terminal IN1 has a power supply (shown as "Input") and the input terminal IN2 does not have a power supply (shown as "N/A"), then the input priority is set to the input terminal IN1, and the output further depends on the enable signal EN. More specifically, as shown in the first row of Table 1, if the input terminal IN1 has a power supply, the input terminal IN2 does not have a power supply, and the enable signal EN is at low level (e.g., disabled), then the dual input power regulator 210 enters the shutdown or low current mode mode and stops generation of the output voltage $V_{OUT}$ on the output terminal OUT (e.g., without output, shown as "N/A"). As shown in the second row of Table 1, if the input terminal IN1 has a power supply, the input terminal IN2 does not have a power supply, and the enable signal EN is at high level, then the dual input power regulator 210 enters the normal operation mode and converts the input voltage $V_{IN1}$ on the input terminal IN1 to the output voltage $V_{OUT}$ on the output terminal OUT (e.g., with output, shown as "Output").

As shown in the third and fourth rows of Table 1, if the input terminal IN2 has a power supply, then the input priority is set to the input terminal IN2 and the input voltage $V_{IN2}$ on the input terminal IN2 is converted to the output voltage $V_{OUT}$ on the output terminal OUT (e.g., with output), regardless of whether or not the input terminal IN1 has a power supply and regardless of whether the enable signal EN is at high level or low level.

According to the generated output voltage $V_{OUT}$ on the output terminal OUT, the dual input power regulator 210 provides the power good signal PG to the MCU 220. For example, if the output voltage $V_{OUT}$ on the output terminal OUT is within the normal range, then the power good signal PG is pulled high by an external resistor connected to the output terminal OUT; on the other hand, if the output voltage $V_{OUT}$ on the output terminal OUT is out of the normal range, then the power good signal PG is pulled low. The power good signal PG can be configured to indicate whether the output voltage $V_{OUT}$ on the output terminal OUT is stable or ready, which can also be used as a reset signal of a processor (e.g., the MCU 220).

Although the priority of the second input terminal IN2 is greater than the priority of the first input terminal IN1 in the above examples, the priority of the first input terminal IN1 can instead be designed to be higher than the priority of the second input terminal IN2.

Advantageously, the dual input power regulator 210 according to the present invention has two modes: the normal operation mode, and the shutdown mode. In the normal operation mode, according to the priority determination logic of the above Table 1, based on the first monitor signal, the second monitor signal, and the enable signal EN, the dual input power regulator 210 determines the input priority of the first input terminal IN1 and the second input terminal IN2 and accordingly generates the output voltage $V_{OUT}$ on the output terminal OUT. In the normal operation mode, the dual input power regulator 210 may consume a relatively large current (e.g., 5 μA). In the shutdown or low current mode, the dual input power regulator 210 is disabled by the enable signal EN of the MCU 220, therefore stopping generation of the output voltage $V_{OUT}$ on the output terminal OUT. In the shutdown or low current mode, the dual input power regulator 210 only consumes a relatively small current (e.g., 1 μA).

Figure 3:
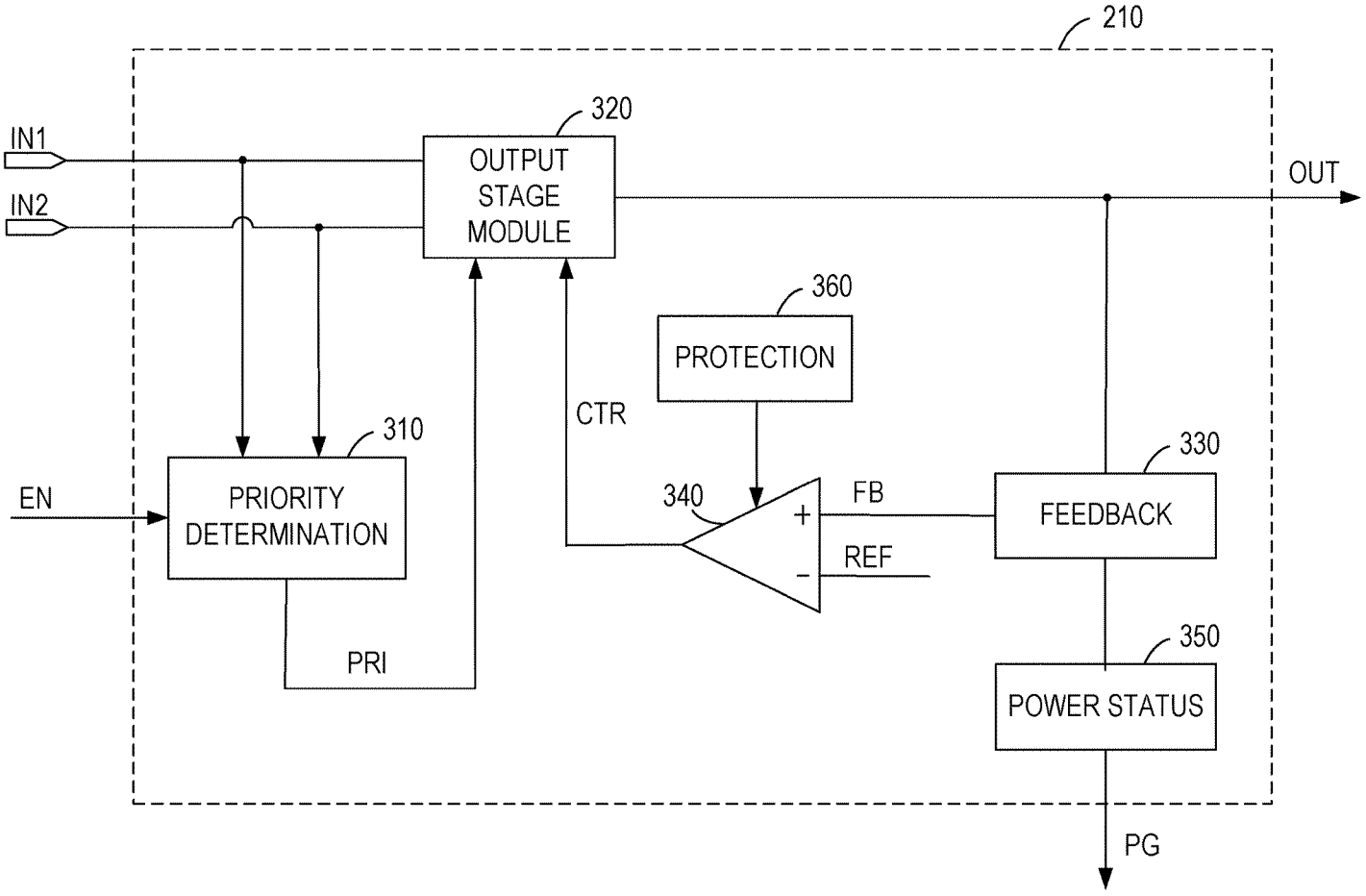
FIG. 3 is a block diagram showing a dual input power regulator according to an embodiment of the present invention.

FIG. 3 is a block diagram showing a dual input power regulator 210 according to an embodiment of the present invention. The dual input power regulator 210 (e.g., an LDO voltage regulator) can convert the input voltage or power supply voltage $V_{IN1}$ or $V_{IN2}$ received from the input terminal IN1 and/or IN2 to the output voltage $V_{OUT}$ on the output terminal OUT. In the example of FIG. 3, the dual input power regulator 210 can include a priority determination module 310, an output stage module 320, a feedback module 330, a compare module (e.g., an error amplifier 340), a power status module 350, and a protection module 360. In an embodiment, the dual input power regulator 210 can also include a compensation circuit (not shown). In another embodiment, the compensation circuit can be placed outside of the dual input power regulator 210.

The output stage module 320 is coupled to the input terminals IN1 and IN2 of the dual input power regulator 210, and can be configured to receive the input voltage $V_{IN1}$ and/or $V_{IN2}$ and to provide the output voltage $V_{OUT}$ to the output terminal OUT of the dual input power regulator 210. The output stage module 320 is controlled by the priority signal PRI from the priority determination module 310 and the control signal CTR from the error amplifier 340. The priority signal PRI is based on the first monitor signal, the second monitor signal, and the enable signal EN and is discussed further in conjunction with FIGS. 4 and 5, below. The control signal CTR is based on the difference between a feedback signal FB indicative of the output voltage $V_{OUT}$ and a reference signal REF. For example, the magnitude of the control signal is proportional to the difference between the feedback signal FB and the reference signal REF.

The priority determination module 310 can be configured to monitor whether the first input terminal IN1 has a power supply and whether the second input terminal IN2 has a power supply, and accordingly generates the first monitor signal and the second monitor signal as described above. Furthermore, the priority determination module 310 determines the input priority of the first input terminal IN1 and the second input terminal IN2 based on the first monitor signal, the second monitor signal, and the received enable signal EN. As described with reference to the above Table 1, if the priority determination module 310 detects or determines that the input terminal IN1 has a power supply and the input terminal IN2 does not have a power supply (e.g., by comparing the input voltage and the preset threshold), and the enable signal EN is at low level (e.g., disabled), then the priority determination module 310 generates the priority signal PRI to make the dual input power regulator 210 enter the shutdown or low current mode mode and stops the generation of the output voltage $V_{OUT}$ on the output terminal OUT (e.g., without output). If the priority determination module 310 detects or determines that the input terminal IN1 has a power supply and the input terminal IN2 does not have a power supply (e.g., by comparing the input voltage and the preset threshold), and the enable signal EN is at high level (e.g., enabled), then the priority determine module 310 generates the priority signal PRI to set the input priority to the input terminal IN1, makes the dual input power regulator 210 enter the normal operation mode, and converts the input voltage $V_{IN1}$ on the input terminal IN1 to the output voltage $V_{OUT}$ on the output terminal OUT (e.g., with output). If the input terminal IN2 has a power supply, then the priority determination module 310 generates the priority signal PRI to set the input priority to the input terminal IN2 regardless of whether or not the input terminal IN1 has a power supply and regardless of whether the enable signal EN is at high level or low level, and the dual input power regulator 210 enters the normal operation mode and converts the input voltage $V_{IN2}$ on the input terminal IN2 to the output voltage $V_{OUT}$ on the output terminal OUT (e.g., with output).

The feedback module 330 coupled to the output terminal OUT is configured to generate the feedback signal FB indicative of the output voltage $V_{OUT}$. For example, the feedback module 330 can include a voltage divider (e.g., resistors), configured to convert the output voltage $V_{OUT}$ to the feedback signal FB. The power status module 350 coupled to the feedback module 330 is configured to generate the power good signal PG according to the output voltage $V_{OUT}$ sensed by the feedback module 330. For example, if the output voltage $V_{OUT}$ on the output terminal OUT is within the normal range, then the power good signal PG is pulled high by an external resistor connected to the output terminal OUT; and if the output voltage $V_{OUT}$ on the output terminal OUT is out of the normal range, then the power good signal PG is pulled low. The power good signal PG can be configured to indicate whether the output voltage $V_{OUT}$ on the output terminal OUT is stable or ready, which can also be used as the reset signal of the MCU 220. The error amplifier 340 coupled to the feedback module 330 is configured to compare the reference signal REF (e.g., a bandgap reference voltage) and the feedback signal FB indicative of the output voltage $V_{OUT}$, and to generate the control signal CTR according to the comparison result to control the output stage module 320. The output stage module 320, the feedback module 330, and the error amplifier 340 form a feedback loop, in order to generate the precise and stable output voltage $V_{OUT}$ on the output terminal OUT.

As described above, based on the priority signal PRI and the control signal CTR, the output stage module 320 selects the input terminal IN1 or IN2 as the input priority, and accordingly regulates the input voltage $V_{IN1}$ or $V_{IN2}$ to the output voltage $V_{OUT}$ on the output terminal OUT.

The error amplifier 340 can also be coupled to the protection module 360. The protection module 360 can provide, including but not limited to, under-voltage lock out (UVLO) protection, over-temperature protection, and over-current protection.

For UVLO protection, the protection module 360 can selectively turn on or off one or more components in the dual input power regulator 210 according to different power conditions. For example, when the voltages on the input terminal IN1 and IN2 are both less than a preset under-voltage lockout threshold, the protection module 360 generates a shutdown signal to turn off components (e.g., one or more or all components) in the dual input power regulator 210. When the voltage on the input terminal IN1 or IN2 is greater than the preset under-voltage lockout threshold, then the protection module 360 stops generation of the shutdown signal to turn on components (e.g., one or more or all components) in the dual input power regulator 210.

For over-temperature protection, the protection module 360 can prevent the dual input power management system 200 from damage due to over-temperature. For example, when the temperature of the dual input power management system 200 is greater than a preset temperature threshold, then the protection module 360 turns off components (e.g., one or more or all components) in the shutdown dual input power regulator 210 until the system temperature drops to the preset temperature threshold.

The protection module 360 can also provide over-current protection for the dual input power management system 200. When the current flowing through the output stage module 320 (e.g., the output stage unit 510 or 520 in FIG. 5) is greater than a preset current threshold, then the protection module 360 sends a control signal to the error amplifier 340 to decrease the current flowing through the output stage module 320. For example, the preset current threshold decreases with decreasing the output voltage $V_{OUT}$ on the output terminal OUT. If the output terminal OUT is connected to ground (e.g., $V_{OUT}$ equals to zero), then the preset current threshold is at its minimum.

Figure 4:
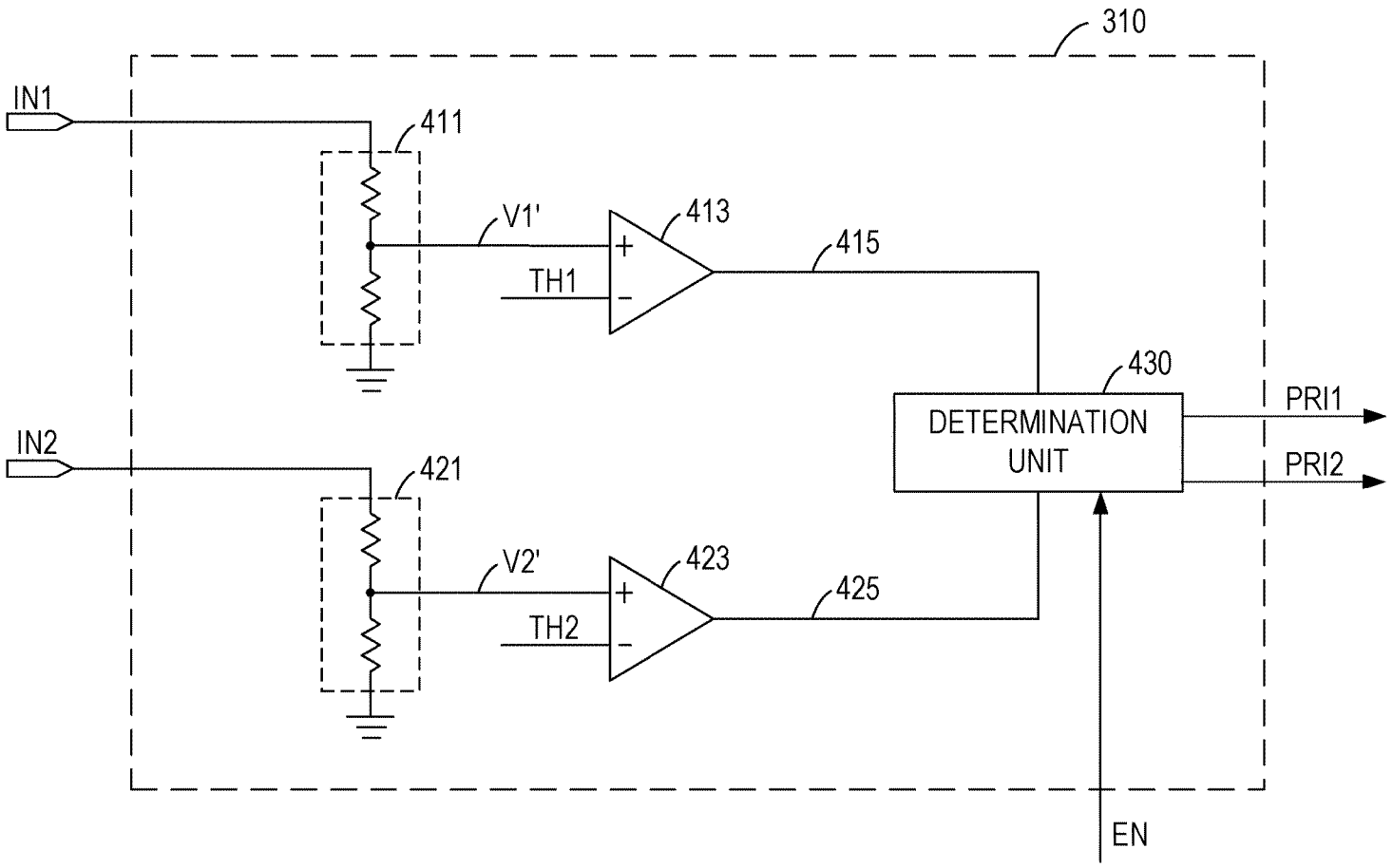
FIG. 4 is a block diagram showing the priority determination module of FIG. 3, according to an embodiment of the present invention.

FIG. 4 is a block diagram showing an embodiment of the priority determination module 310 of FIG. 3. In the example of FIG. 4, the priority determination module 310 can include voltage dividers 411 and 421, error amplifiers 413 and 423, and a determination unit 430. The voltage dividers 411 and 421 are respectively connected to the input terminals IN1 and IN2.

For a first determination path connected to the first input terminal IN1, the voltage divider 411 is configured to convert the input voltage $V_{IN1}$ on the input terminal IN1 to a divided voltage V1'. The error amplifier 413 compares the divided voltage V1' and a preset monitor threshold TH1 and generates a first monitor signal 415. In an embodiment, if the divided voltage V1' is greater than the preset monitor threshold TH1, then the first monitor signal 415 is in a first state (e.g., high level), which indicates that the first input terminal IN1 has a power supply. If the divided voltage V1' is less than the preset monitor threshold TH1, then the first monitor signal 415 is in a second state (e.g., low level), which indicates that the first input terminal IN1 does not have a power supply.

Similarly, for a second determination path connected to the second input terminal IN2, the voltage divider 421 is configured to convert the input voltage $V_{IN2}$ on the input terminal IN2 to a divided voltage V2'. The error amplifier 423 compares the divided voltage V2' and another preset monitor threshold TH2 and generates a second monitor signal 425. In an embodiment, if the divided voltage V2' is greater than the preset monitor threshold TH2, then the second monitor signal 425 is in a first state (e.g., high level), which indicates that the second input terminal IN2 has a power supply. If the divided voltage V2' is less than preset monitor threshold TH2, then the second monitor signal 425 is in a second state (e.g., low level), which indicates that the second input terminal IN2 does not have a power supply.

The preset monitor thresholds TH1 and TH2 can be the same (e.g., both equal to 1.2V) or they can be different. Furthermore, the resistance ratios of the voltage dividers 411 and 421 can be the same or different (e.g., 1:4 and 1:3, respectively). These values are examples only; the invention is not so limited.

The determination unit 430 receives the first monitor signal 415 (which indicates whether the first input terminal IN1 has a power supply), the second monitor signal 425 (which indicates whether the second input terminal IN2 has a power supply), and the enable signal EN from the MCU 220. The determination unit 430 generates a priority signal PRI to determine the input priority of the first input terminal IN1 and the second input terminal IN2. For example, based on the first monitor signal 415, the second monitor signal 425, and the enable signal EN, the determination unit 430 determines the input priority of the first input terminal IN1 and the second input terminal IN2, selects the first input terminal IN1 or second input terminal IN2 as the input, and generates the priority signal PRI to control the output stage module 320. In an example, such as the example of FIG. 4 and FIG. 5, the priority signal PRI includes two separate signals PRI1 and PRI2 to control the output stage units 510 or 520 in FIG. 5, respectively. If the priority signal PRI1 is asserted, then the input priority is set to the input terminal IN1, and if the priority signal PRI2 is asserted, then the input priority is set to the input terminal IN2. However, the present invention is not limited to this type of implementation. For example, a single priority signal can include two binary bits (e.g., 00 indicates that no input terminal is selected as the input, 01 indicates that the first input terminal IN1 is selected as the input, and 10 indicates that the second input terminal IN2 is selected as the input), and the value of those bits can be used to control the output stage module 320. The output stage module 320 is configured to convert the corresponding input voltage $V_{IN1}$ or $V_{IN2}$ to the output voltage $V_{OUT}$ on the output terminal OUT based on the priority signals PRI1 and PRI2. An example of the determination logic is provided above in Table 1.

Figure 5:
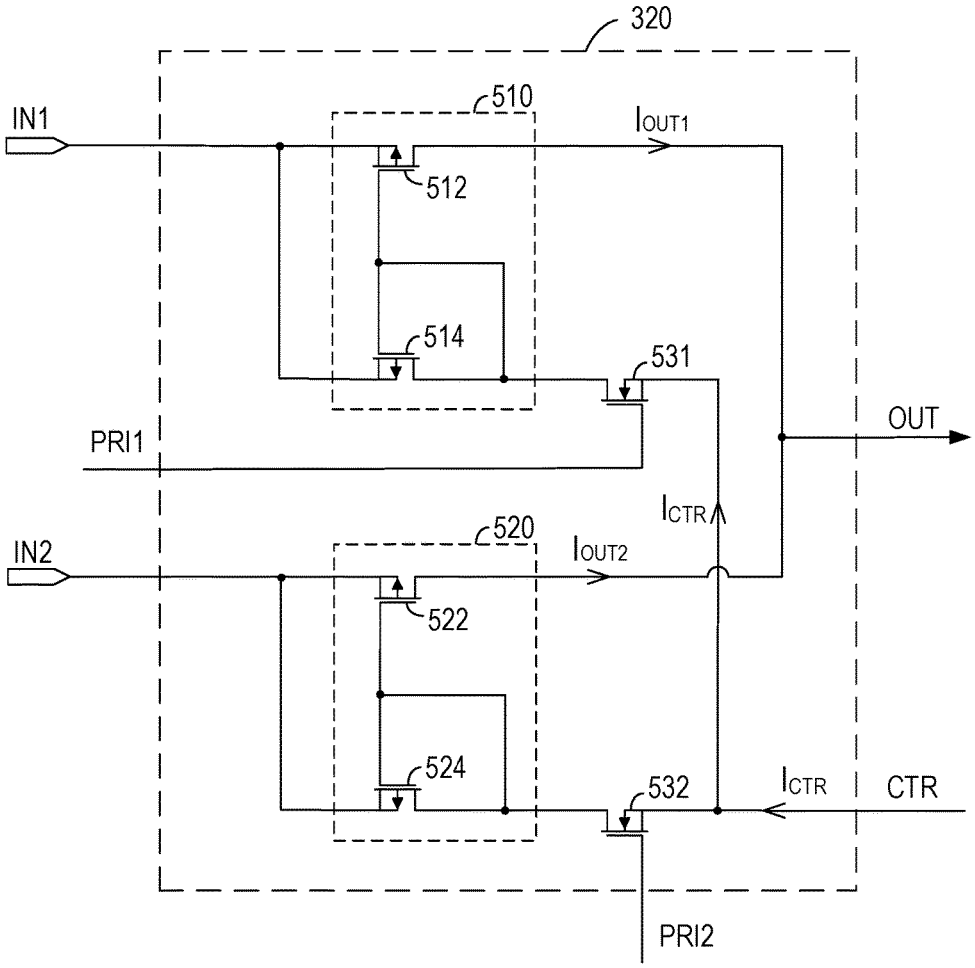
FIG. 5 is a block diagram showing the output stage module of FIG. 3, according to an embodiment of the present invention.

FIG. 5 is a block diagram showing an embodiment of the output stage module 320 of FIG. 3. In an embodiment, the output stage module 320 includes output stage units 510 and 520, respectively connected to the input terminals IN1 and IN2. The output stage unit 510 can be a current mirror formed by p-type metal-oxide semiconductior (PMOS) transistors 512 and 514. A switch transistor (e.g., an n-type MOS transistor) 531 is connected to the output stage unit 510, and is controlled by the priority signal PRI1 from the priority determination module 310. If the priority signal PRI1 sets the input priority to the input terminal IN1, then the switch transistor 531 is turned on and the output stage unit 510 is activated. As mentioned above, a single priority signal PRI can be used, in which case the output stage module 320 includes circuitry (not shown) that determines the value of that signal and determines which if any of the input terminals IN1 and IN2 is selected based on that value. According to the control current $I_{CTR}$ of the control signal CTR from the error amplifier 340, the output stage unit 510 generates the output current $I_{OUT1}$ on the output terminal OUT. Similarly, the output stage unit 520 can be a current mirror formed by PMOS transistors 522 and 524. A switch transistor (e.g., an NMOS transistor) 532 is connected to the output stage unit 520, and is controlled by the priority signal PRI2 from the priority determination module 310. If the priority signal PRI2 sets the input priority to the input terminal IN2, then the switch transistor 532 is turned on and the output stage unit 520 is activated. According to the control current $I_{CTR}$ of the control signal CTR from the error amplifier 340, the output stage unit 520 generates the output current $I_{OUT2}$ on the output terminal OUT. The ratio of the current mirror can be preset.

Operation of the dual input power regulator 210 is now described with reference to FIGS. 4 and 5.

In one example, if the first monitor signal 415 indicates that the input terminal IN1 has a power supply and the second monitor signal 425 indicates that the input terminal IN2 does not have a power supply, then the determination unit 430 sets the input priority to the input terminal IN1 and the output further depends on the enable signal EN. More specifically, if the input terminal IN1 has a power supply, the input terminal IN2 does not have a power supply, and the enable signal EN is at low level (e.g., disabled), then the dual input power regulator 210 enters the shutdown or low current mode and stops generation of the output voltage $V_{OUT}$ on the output terminal OUT (e.g., without output). In this situation, the priority signal PRI1 turns off the switch transistor 531 and the priority signal PRI2 turns off the switch transistor 532. In this manner, the output stage units 510 and 520 are disabled. In contrast, if the input terminal IN1 has a power supply, the input terminal IN2 does not have a power supply, and the enable signal EN is at high level, then the dual input power regulator 210 enters the normal operation mode and converts the input voltage $V_{IN1}$ on the input terminal IN1 to the output voltage $V_{OUT}$ on the output terminal OUT (e.g., with output). In this situation, the priority signal PRI1 turns on the switch transistor 531 and the priority signal PRI2 turns off the switch transistor 532. In this manner, the output stage unit 510 is activated and the output stage unit 520 is disabled. The output stage unit 510 generates the output current $I_{OUT1}$ according to the control current $I_{CTR}$.

If the second monitor signal 425 indicates that the input terminal IN2 has a power supply, then the input priority is set to the input terminal IN2 regardless of whether or not the input terminal IN1 has a power supply and regardless of whether the enable signal EN is at high level or low level, and the dual input power regulator 210 enters the normal operation mode and the input voltage $V_{IN2}$ on the input terminal IN2 is converted to the output voltage $V_{OUT}$ on the output terminal OUT (e.g., with output). In this situation, the priority signal PRI1 turns off the switch transistor 531 and the priority signal PRI2 turns on the switch transistor 532. In this manner, the output stage unit 510 is disabled and the output stage unit 520 is activated. The output stage unit 520 generates the output current $I_{OUT2}$ according to the control current $I_{CTR}$.

Furthermore, the control signal CTR (e.g., the amount/level of control current $I_{CTR}$) can indicate the amount of difference between the reference signal REF (e.g., a bandgap reference voltage) and the feedback signal FB indicative of the output voltage $V_{OUT}$. Therefore, the output current ($I_{OUT1}$ or $I_{OUT2}$) and the output voltage $V_{OUT}$ are regulated. The output stage module 320, the feedback module 330, and the error amplifier 340 form a feedback loop, in order to generate the precise and stable output voltage $V_{OUT}$ on the output terminal OUT.

Figure 6:
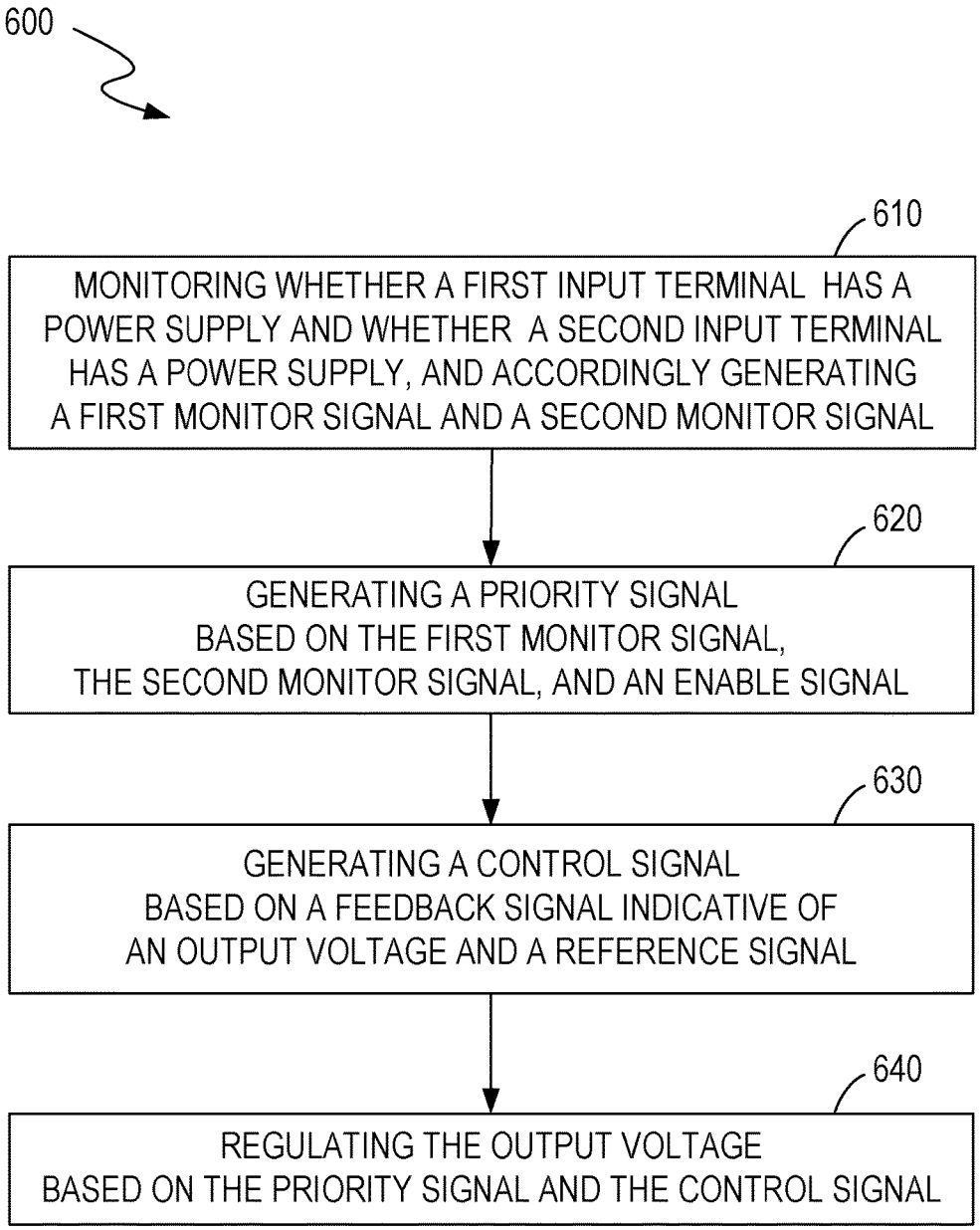
FIG. 6 is a flowchart showing a dual input power management method according to an embodiment of the present invention.

FIG. 6 is a flowchart showing a dual input power management method 600 according to an embodiment of the present invention. FIG. 6 is described in combination with FIG. 1 to FIG. 5.

Step 610 includes monitoring whether a first input terminal has a power supply and whether a second input terminal has a power supply, and accordingly generating a first monitor signal and a second monitor signal as described above. For example, the dual input power regulator 210 monitors whether the first input terminal IN1 (e.g., 6V) has a power supply and whether the second input terminal IN2 (e.g., 4.5V) has a power supply, and accordingly generates the first monitor signal and the second monitor signal as described above.

Step 620 includes generating a priority signal (e.g., a priority signal PRI including two separate priority signals PRI1 and PRI2) based on the first monitor signal, the second monitor signal, and an enable signal, to determine an input priority of the first input terminal and the second input terminal. For example, in an embodiment, if the input terminal IN1 has a power supply and the input terminal IN2 does not have a power supply, then the input priority is set to the input terminal IN1 and the output further depends on the enable signal EN. More specifically, if the input terminal IN1 has a power supply, the input terminal IN2 does not have a power supply, and the enable signal EN is in low level (e.g., disabled), then the dual input power regulator 210 enters the shutdown or low current mode and stops generation of the output voltage $V_{OUT}$ on the output terminal OUT (e.g., without output). In contrast, if the input terminal IN1 has a power supply, the input terminal IN2 does not have a power supply, and the enable signal EN is in high level, then the dual input power regulator 210 enters the normal operation mode and converts the input voltage $V_{IN1}$ on the input terminal IN1 to the output voltage $V_{OUT}$ on the output terminal OUT (e.g., with output).

If the input terminal IN2 has a power supply, then the input priority is set to the input terminal IN2 regardless of whether or not the input terminal IN1 has a power supply or not and regaardless of whether the enable signal EN is in high level or low level, and the input voltage $V_{IN2}$ on the input terminal IN2 is converted to the output voltage $V_{OUT}$ on the output terminal OUT (i.e., with output).

Step 630 includes generating a control signal based on a feedback signal indicative of an output voltage and a reference signal. In an embodiment, the error amplifier 340 compares the reference signal REF (e.g., a bandgap reference voltage) and the feedback signal FB indicative of the output voltage $V_{OUT}$, and generates the control signal CTR according to the comparison result. The output stage module 320, the feedback module 330, and the error amplifier 340 form the feedback loop, in order to generate the precise and stable output voltage $V_{OUT}$ on the output terminal OUT.

Step 640 includes regulating the output voltage based on the priority signal and the control signal. In an embodiment, based on the priority signal PRI and the control signal CTR, the output stage module 320 selects the input terminal IN1 or IN2 as the input priority, and accordingly regulates the input voltage $V_{IN1}$ or $V_{IN2}$ to the output voltage $V_{OUT}$ on the output terminal OUT.

Although the priority of the second input terminal is greater than the priority of the first input terminal in the above description, the invention is not so limited; instead, the priority of the first input terminal can be greater than the priority of the second input terminal.

Advantageously, the dual input power regulator 210 according to the present invention has at least two modes: the normal operation mode and the shutdown mode. In the normal operation mode, according to the priority determination logic of Table 1, based on the first monitor signal, the second monitor signal, and the enable signal EN, the dual input power regulator 210 determines the input priority of the first input terminal IN1 and the second input terminal IN2 and accordingly generates the output voltage $V_{OUT}$ on the output terminal OUT. In this situation, the dual input power regulator 210 may consume a relatively large current (e.g., 5 μA). In the shutdown mode, the dual input power regulator 210 is disabled by the enable signal EN of the MCU 220, therefore stopping the generation of the output voltage $V_{OUT}$ on the output terminal OUT. At this time, the dual input power regulator 210 may only consume a relatively small current (e.g., 1 μA).

While the foregoing description and drawings represent embodiments of the present invention, it will be understood that various additions, modifications, and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A dual input power management method, comprising:

monitoring whether a first input terminal has a power supply and whether a second input terminal has a power supply, and accordingly generating a first monitor signal and a second monitor signal;

generating a priority signal based on the first monitor signal, the second monitor signal, and an enable signal, to determine an input priority of the first input terminal and the second input terminal;

generating a control signal based on a feedback signal indicative of an output voltage and a reference signal; and regulating the output voltage based on the priority signal and the control signal.

2. The method according to claim 1, wherein said monitoring comprises:

converting a first input voltage on the first input terminal to a first divided voltage;

comparing the first divided voltage and a first preset monitor threshold, and accordingly generating the first monitor signal;

converting a second input voltage on the second input terminal to a second divided voltage; and comparing the second divided voltage and a second preset monitor threshold, and accordingly generating the second monitor signal.

3. The method according to claim 1, wherein said generating a priority signal comprises:

when the first monitor signal indicates that the first input terminal has the power supply, the second monitor signal indicates that the second input terminal does not have the power supply, and the enable signal is in a first state, then stopping generation of the output voltage; and when the first monitor signal indicates that the first input terminal has the power supply, the second monitor signal indicates that the second input terminal does not have the power supply, and the enable signal is in a second state, then setting the input priority to the first input terminal and converting a first input voltage on the first input terminal to the output voltage.

4. The method according to claim 1, wherein said generating a priority signal comprises:

when the second monitor signal indicates that the second input terminal has the power supply, then setting the input priority to the second input and converting a second input voltage on the second input terminal to the output voltage.

5. The method according to claim 1, further comprising:

generating a power good signal according to the output voltage; and using the power good signal as a reset signal of a processor.

6. The method according to claim 1, further comprising:

when the voltages on the first input terminal and the second input terminal are less than a preset under-voltage lockout threshold, then generating a shutdown signal to turn off components in a dual input power regulator; and when one of the voltage on the first input terminal and the voltage on the second input terminal is greater than the preset under-voltage lockout threshold, then stopping generation of the shutdown signal to turn on the components in the dual input power regulator.

7. The method according to claim 1, further comprising:

when a system temperature is greater than a preset temperature threshold, then turning off components in a dual input power regulator, until the system temperature drops to the preset temperature threshold.

8. The method according to claim 1, further comprising:

when a current flowing through an output stage module is greater than a preset current threshold, then decreasing the current flowing through the output stage module.

9. A dual input power management system comprising a dual input power regulator, wherein the dual input power regulator comprises:

a priority determination module, configured to: monitor whether a first input terminal has a power supply and whether a second input terminal has a power supply, and accordingly generate a first monitor signal and a second monitor signal; generate a priority signal based on the first monitor signal, the second monitor signal, and an enable signal to determine an input priority of the first input terminal and the second input;

a feedback module, configured to generate a feedback signal indicative of an output voltage;

a compare module coupled to the feedback module, and configured to generate a control signal based on the feedback signal and a reference signal; and an output stage module, coupled to the priority determination module and the compare module, and configured to regulate the output voltage based on the priority signal and the control signal.

10. The system according to claim 9, wherein the priority determination module comprises:

a first voltage divider, configured to convert a first input voltage on the first input terminal to a first divided voltage;

a first error amplifier, configured to compare the first divided voltage and a first preset monitor threshold, and accordingly generate the first monitor signal;

a second voltage divider, configured to convert a second input voltage on the second input terminal to a second divided voltage; and a second error amplifier, configured to compare the second divided voltage and a second preset monitor threshold, and accordingly generate the second monitor signal.

11. The system according to claim 9, wherein the priority determination module comprises:

a determination unit, configured to generate the priority signal based on the first monitor signal, the second monitor signal, and the enable signal, to determine the input priority of the first input terminal and the second input, wherein when the first monitor signal indicates that the first input terminal has the power supply, the second monitor signal indicates that the second input terminal does not have the power supply, and the enable signal is in a first state, then the determination unit determines that the dual input power regulator enters a shutdown mode and stops generation of the output voltage; and wherein when the first monitor signal indicates that the first input terminal has the power supply, the second monitor signal indicates that the second input terminal does not have the power supply, and the enable signal is in a second state, then the determination unit sets the input priority to the first input terminal and the dual input power regulator converts the first input voltage on the first input terminal to the output voltage.

12. The system according to claim 9, wherein the priority determination module comprises:

a determination unit, configured to generate the priority signal based on the first monitor signal, the second monitor signal, and the enable signal, to determine the input priority of the first input terminal and the second input, wherein when the second monitor signal indicates that the second input terminal has the power supply, then the determination unit sets the input priority to the second input and the dual input power regulator converts the second input voltage on the second input terminal to the output voltage.

13. The system according to claim 9, further comprising:

a processor, coupled to the dual input power regulator, and configured to provide the enable signal to the dual input power regulator.

14. The system according to claim 13, wherein the dual input power regulator further comprises:

a power status module, coupled to the feedback module, and configured to generate a power good signal according to the output voltage and send the power good signal to the processor as a reset signal.

15. The system according to claim 9, wherein the dual input power regulator further comprises a protection module coupled to the feedback module and configured to:

generate a shutdown signal to turn off components in the dual input power regulator when the voltages on the first input terminal and the second input terminal are less than a preset under-voltage lockout threshold; and stop generation of the shutdown signal to turn on the components in the dual input power regulator when one of the voltage on the first input terminal and the voltage on the second input terminal is greater than the preset under-voltage lockout threshold.

16. The system according to claim 9, wherein the dual input power regulator further comprises a protection module coupled to the feedback module and configured to turn off components in the dual input power regulator when a temperature of the system is greater than a preset temperature threshold and until the temperature drops to the preset temperature threshold.

17. The system according to claim 9, wherein the dual input power regulator further comprises a protection module coupled to the feedback module and configured to decrease the current flowing through the output stage module if a current flowing through an output stage module is greater than a preset current threshold.

18. The system according to claim 9, wherein the output stage module comprises:

a first output stage unit coupled to the first input terminal, and a second output stage unit coupled to the second input terminal, wherein the first output stage unit and the second output stage unit are controlled by the priority signal and the control signal.

19. The system according to claim 18, wherein the first output stage unit and the second output stage unit comprise a current mirror, are enabled and disabled based on the priority signal, and generate an output current according to a control current of the control signal.

20. The system according to claim 19, wherein:

when the first monitor signal indicates that the first input terminal has the power supply, the second monitor signal indicates that the second input terminal does not have the power supply, and the enable signal is in a first status, then the priority signal disables the first output stage unit and the second output stage unit;

when the first monitor signal indicates that the first input terminal has the power supply, the second monitor signal indicates that the second input terminal does not have the power supply, and the enable signal is in a second status, then the priority signal enables the first output stage unit and disables the second output stage unit, and the first output stage unit generates the output current according to the control current; and when the second monitor signal indicates that the second input terminal has the power supply, then the priority signal disables the first output stage unit and enables the second output stage unit and the second output stage unit generates the output current according to the control current.

* * * * *